United States Patent [19]

Yoshida

[11] Patent Number: 4,495,274

[45] Date of Patent: Jan. 22, 1985

[54] DIRECT-POSITIVE SILVER HALIDE PHOTOGRAPHIC MATERIAL

[75] Inventor: Kazuhiro Yoshida, Hino, Japan

[73] Assignee: Konishiroku Photo Industry Co., Ltd., Tokyo, Japan

[21] Appl. No.: 487,216

[22] Filed: Apr. 21, 1983

[30] Foreign Application Priority Data

Apr. 26, 1982 [JP] Japan ..... 57-68785

[51] Int. Cl.[3] ..... G03C 1/36

[52] U.S. Cl. ..... 430/523; 430/597; 430/596; 430/605; 430/608; 430/606; 430/599; 430/607; 430/614; 430/611; 430/940

[58] Field of Search ..... 430/940, 596, 597, 605, 430/606, 608, 599, 611, 614, 607, 523

[56] References Cited

U.S. PATENT DOCUMENTS

| | | | |
|---|---|---|---|
| 3,062,651 | 11/1962 | Hillson | 430/597 |
| 3,672,903 | 6/1972 | Chang | 430/597 |
| 3,865,596 | 2/1975 | Furuya et al. | 430/940 |
| 3,942,986 | 3/1976 | Florens | 430/940 |

*Primary Examiner*—Won H. Louie

*Attorney, Agent, or Firm*—Jordan B. Bierman

[57] ABSTRACT

Direct positive silver halide photographic materials comprising a support, a silver halide emulsion layer comprising fogged silver halide particles prepared in the presence of a water soluble iridium salt or a water soluble rhodium salt, and a hydrophilic colloidal layer comprising (a) a compound selected from Formula I and II and (b) at least one compound selected from the group consisting of Formula III and a gold compound, said Formula I being

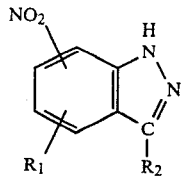

wherein $R_1$ is hydrogen, alkyl, —$SO_3M$, or —COOM, wherein M is selected from hydrogen, alkali metals, and ammonium, and $R_2$ is selected from hydrogen and lower alkyls, said Formula II being

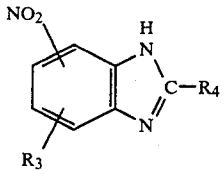

wherein $R_3$ is selected from hydrogen, alkyl, —$SO_3M$, and —COOM, and $R_4$ is selected from hydrogen, alkyl, and —$CH_2$—S—$(CH_2)_n$—Y′, wherein n is an integer of from 1 to 3, and Y′ is selected from hydrogen and —$SO_3M$, and said Formula III being $$H_2N—Y—NH—Y]_mNH_2$$

wherein m is an integer of from 1 to 5 and Y is an alkylene radical having from 2 to 4 carbon atoms, provided at least two Y groups present within the same molecule are different alkylene radicals.

20 Claims, No Drawings

DIRECT-POSITIVE SILVER HALIDE PHOTOGRAPHIC MATERIAL

The present invention relates to a direct-positive-type silver halide photographic light-sensitive material, and more particularly to a low-photographic-speed direct-positive-type silver halide photographic light-sensitive material. In recent years, in the field of graphic arts, because of the increasing complexity of prints as well as of the development of scanners, there has been a demand for improvement on the efficiency of the contact printing operation process. To meet such a demand, both improvements from the side of such equipment as printers and from the side of light-sensitive materials have been in progress. In the area of light-sensitive materials, there have been developed such low-speed silver halide photographic light-sensitive materials as called "semi-daylight-type light-sensitive materials" which can be handled under an yellow lamp light or as called "daylight-type light-sensitive materials" which can be handled in an ordinary room light. However, these light-sensitive materials have the disadvantage that the speed thereof becomes unstable to vary, the contrast thereof becomes reduced, or the minimum density thereof becomes increasing when stored over a long period or under a high-temperature-high-humidity condition, so that a still further improvement of these materials is desired.

In high-speed direct-positive-type silver halide emulsions, many attempts have been made until now to improve the preservability thereof. For example, U.S. Pat. No. 3,672,903 proposes a production of a direct-positive-type silver halide emulsion, which comprises fogging of a silver halide emulsion before adding a gold complex salt thereto. And Japanese Patent Publication Open to Public Inspection (hereinafter referred to as Japanese Patent O.P.I. Publication) No. 66828/1973 discloses a production of a direct-reversal silver halide light-sensitive material which comprises the addition of a polyamine, a salt of a metal having a more noble potential than does silver, and a certain compound to a silver halide emulsion. However, if the above technique for high-speed emulsions should be applied to low-speed direct-positive-type silver halide emulsions, the application, although useful for the prevention of possible occurrence of speed variations during the storage for a long period or under a high-temperature-high-humidity condition, has the disadvantage that it causes the emulsion to increase fog.

It is therefore an object of the present invention to provide a low-speed direct-positive-type silver halide photographic light-sensitive material.

It is another object of the present invention to provide a low-speed direct-positive-type silver halide photographic light-sensitive material whose speed is stable and whose minimum density is small under a high-temperature-high-humidity condition.

It is a further object of the present invention to provide a silver halide photographic light-sensitive material which can be safely handled under an yellow lamp light or in a bright room light free of ultraviolet rays.

Still another object of the present invention will become apparent from the following descriptions.

The above objects of the present invention are accomplished by a direct-positive-type silver halide light-sensitive material comprising a support, a silver halide emulsion layer comprising fogged silver halide particles prepared in the presence of a water soluble iridium salt or a water soluble rhodium salts, and a hydrophilic colloidal layer comprising a compound selected from the group consisting of compounds having the following Formula [I] and [II] and at least one compound selected from the group consisting of a compound having the following Formula [II] and a gold compound.

Formula [I]

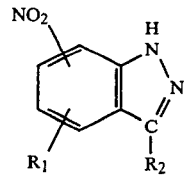

wherein $R_1$ is hydrogen, an alkyl radical (e.g., methyl, ethyl, propyl or butyl radical), $—SO_3M$ or —COOM radical wherein M is hydrogen, an alkaline metal (e.g., sodium atom, potassium atom) or ammonium ion, and $R_2$ is hydrogen or a lower alkyl radical (e.g., methyl, ethyl, propyl, or butyl radical), Formula [II]

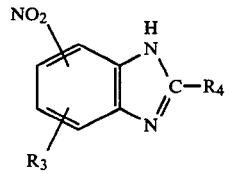

wherein $R_3$ is hydrogen, an alkyl radical (e.g., methyl, ethyl, propyl or butyl radical), $—S_3M$ or —COOM radical wherein M is hydrogen, an alkaline metal (e.g., sodium atom, potassium atom) or ammonium ion, and $R_4$ is hydrogen, an alkyl radical (e.g., methyl, ethyl, butyl, pentyl or heptyl radical) or $—CH_2—S—(CH_2)_n—Y'$ wherein n is an integer of from 1 to 3, and Y' is hydrogen or $—SO_3M$ radical, Formula [III]

$$H_2N—Y\text{-}\!\!\left[NH—Y\right]\!\!\text{-}_nNH_2$$

wherein n is an integer of from 1 to 5, and Y is an alkylene radical having from 2 to 4 carbon atoms (e.g., ethylene, propylene or butylene radical), providing that not less than two Ys which are present inside the same molecule are allowed to be different alkyl radicals.

A characteristic of the present invention is such that at least two compounds, one selected from among those nitro-substituted nitrogen-containing heterocyclic compounds having Formulas [I] and [II] and another selected from among those having Formula [III] and those gold compounds which will be described hereinafter, are contained in the component hydrophilic colloidal layer of a direct-positive-type silver halide photographic light-sensitive material.

The hydrophilic colloidal layer which is to contain these at least two compounds is desirable to be comprised of at least one silver halide emulsion layer and/or an adjacent layer thereto (which may be either a light-sensitive layer or nonlight-sensitive layer; the same shall apply hereinafter). These at least two compounds may not necessarily be contained together in a same hydrophilic colloidal layer but are desirable to be contained together in at least one silver halide emulsion layer and/or an adjacent layer thereto.

The following are examples of those nitro-substituted nitrogen-containing heterocyclic compounds having Formulas [I] and [II] which are applicable to the present invention:

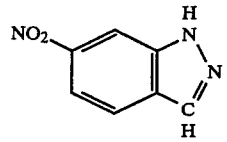
(a)

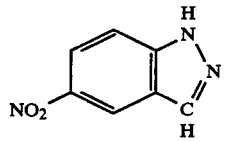
(b)

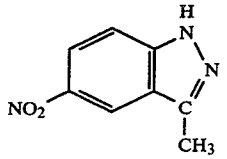
(c)

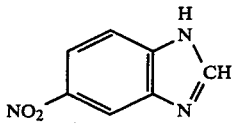
(d)

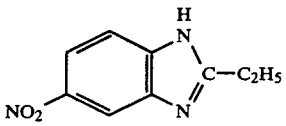
(e)

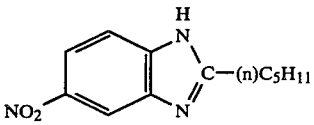
(f)

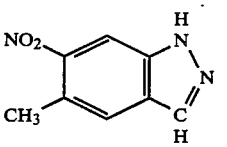
(g)

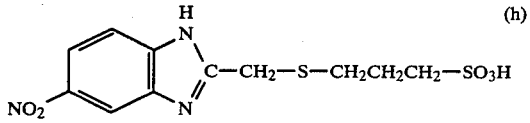
(h)

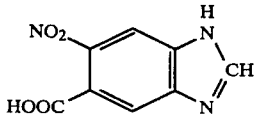
(i)

In order to incorporate any of these compounds having Formulas [I] and [II] into the hydrophilic colloidal layer of a silver halide photographic light-sensitive material, it may be added in the form of a solution dissolved in a solvent such as water or methanol or a mixture thereof to the coating liquid of a silver halide emulsion layer and/or an adjacnet layer thereto. The adding quantity of any of these compounds having Formulas [I] and [II], although different according to the kind of the compound to be used or to the kind of the silver halide to be used, is generally from $1.0\times10^{-6}$ to $1.0\times10^{-1}$ moles, and preferably from $1.0\times10^{-5}$ to $5.0\times10^{-2}$ moles per mole of silver halide.

In the case of adding to a silver halide emulsion layer, the addition, although allowed to be made in any step of the process for the preparation of a direct-positive-type silver halide photographic emulsion, is desirable to be made after completion of the second ripening of the emulsion.

The following are examples of those compounds having Formula [III] which are applicable to the present invention:

(1) Diethyltriamine
(2) Triethylenetetramine
(3) Tetraethylenepentamine
(4) Pentaethylenehexamine
(5) Hexaethyleneheptamine
(6) Tripropylenetetramine
(7) Dibutylenetriamine
(8) Spermine
(9) Spermidine
(10) N-(4-aminobutyl)cadaverine The preferred adding quantity of any of these compounds having Formula [III] is generally from $1.0\times10^{-7}$ to $1.0\times10^{-2}$ moles, and preferably from $1.0\times10^{-5}$ to $5.0\times10^{-3}$ moles per mole of silver halide. In the case of adding to a silver halide emulsion layer, the addition, although allowed to be made in any step of the process for the preparation of a direct positive silver halide photographic emulsion, is desirable to be made after completion of the second ripening of the emulsion Examples of those gold compounds usable in the present invention are monovalent and trivalent water-soluble gold salts such as chloroauric acid, potassium chloroaurate, gold thiocyanate, sodium chloroaurate, potassium aurate, potassium chloroaurate, potassium bromoaurate, potassium iodoaurate, potassium gold cyanide, potassium gold thiocyanide, gold thioglucose, and the like, but are not limited thereto The adding quantity of any of these gold compounds should be generally from $1.0\times10^{-7}$ to $1.0\times10^{-4}$ moles, and preferably from $1.0\times10^{-6}$ to $5.0\times10^{-4}$ moles per mole of silver halide. In the case of adding to a silver halide emulsion layer, the addition of any of these compounds, although allowed to be made in any step of the process for preparation of a direct-positive-type silver halide photographic emulsion, is desirable to be made upon completion of the chemical ripening because, if made after the desalting and before completion of the chemical ripening, the gold compound would be consumed, or if made before the desalting, the gold compound would be lost during the desalting. If the addition should be made before completion of the chemical ripening, the adding quantity should be increased by the amount expected to be consumed by the chemical ripening as stated above. In addition, in the present invention, at least one selected from among these compounds having Formula [III] and gold compounds described above may be added.

The silver halide used in the present invention may be produced by any of the acid method, the neutral method and the ammonia method, and includes silver bromide, silver chloride, silver chlorobromide, silver iodobromide, silver chloroiodobromide, and the like.

The preferred particle size of the silver halide to be used in the present invention is from 0.01 to 2μ, and more preferably from 0.02 to 1$\mu$ in diameter. The particle size frequency distribution, although allowed to be either wider or narrower, is desirable to be narrower. Further, the form or structure of these silver halides may be either regular or irregular, but is desired to be regular.

The direct-positive-type silver halide usable in the present invention may contain an organic desensitizer that is to be adsorbed onto the silver halide particle surface.

In the present invention, the water soluble iridium salt or rhodium salt may be added in the form of an aqueous solution to the silver halide at the time of preparing the particles thereof in order to incorporate the internal electron accepter into the silver halide particles. The iridium salt includes a potassium iridium (III) hexachloride and a sodium iridium (III) hexachloride. The rhodium salt includes a rhodium (III) trichloride, a rhodium (IV) tetrachloride and a potassium rhodium (III) hexabromide. These salts may be added in a quantity of from $10^{-7}$ to $10^{-3}$ moles, and preferably from $10^{-5}$ to $10^{-3}$ moles per mole of silver halide.

The direct-positive-type photographic silver halide to be used in the present invention is in advance fogged. Namely, the silver halide, after the water-soluble salt is removed therefrom, may be fogged by any of conventionally known techniques. The fogging may be made either by use of a reducing agent alone or by combined use of a reducing agent with a gold compound. Useful examples of such reducing agents are typified by, e.g., formalin, hydrazine, polyamines (such as triethylenetetramine, tetraethylenepentamine, etc.), thiourea dioxide, tetra(hydroxy-methyl)phosphonium chloride, boron compounds (such as amineborane, sodium borohydride, etc.), stannous chloride, and the like, and any of these agents is desirable to be used generally in a quantity of from $2.0\times10^{-6}$ to $2.0\times10^{-3}$ moles per mole of silver halide.

A gold compound may be used for the chemical sensitization in fogging the silver halide emulsion to be used in the light-sensitive material of the present invention.

Typical examples of those gold compounds useful for the present invention are chloroauric acid, potassium chloroaurate, gold sulfide, gold selenide, and the like, and any of these compounds is desired to be used generally in a quantity of from $1.0\times10^{-6}$ to $1.0\times10^{-4}$ moles per mole of silver halide.

The fogging degree of the direct-positive-type photographic silver halide in the present invention is changeable over a wide range. The fogging degree is related not only to the silver halide composition, the particle size, etc., of the silver halide emulsion used but also to the kind and concentration of the fogging agent used, the pH, pAg, temperature, time, etc., of the emulsion at the time of the fogging, and the like, so that the fogging degree may be controlled by arbitrarily setting these factors.

Those organic desensitizers which may be added to the fogged silver halide emulsion include, e.g., those 7-member ring desensitizers as disclosed in Japanese patent Examined publication No. 14500/1968, those nitro radical-containing fluorene derivatives as disclosed in Japanese patent O.P.I. publication No. 84432/1974, those nitrophenylmercapto radical-containing compounds as disclosed in Japanese patent O.P.I. publication No. 84639/1974, those nitro-styryl-type compounds, pinacryptol yellow, 5-methanitrobenzylidene-rhodanine, etc., as disclosed in U.S. Pat. No. 2,669,515. The preferred adding quantity of these organic desensitizers is $1.0\times10^{-6}$ to $1.0\times10^{-1}$ moles, and more preferably from $1.0\times10^{-5}$ to $1.0\times10^{-2}$ moles per mole of silver halide.

The direct-positive-type silver halide emulsion of the present invention may contain at least one solarization accelerator selected from among such solarization accelerators as those selenium compounds as described in Japanese Patent O.P.I. Publication No. 4282/1971, and those halogen-liberating photo-active compounds, water-soluble halogenides, nitro-substituted indazoles, nitro-substituted imidazoles, and the like, as described in Japanese patent O.P.I. publication No. 89020/1975.

Further, the direct-positive-type silver halide photographic light-sensitive material of the present invention may also contain a dye capable of absorbing visible rays to be cut so that the light-sensitive material can be handled in a relatively bright place where ultraviolet rays-free fluorescent lamp light is used. The dye includes, for example, oxonol dyes, azo dyes, benzylidene dyes, and the like.

The direct-positive-type silver halide photographic light-sensitive material of the present invention may also contain generally used various other photographic additives which include stabilizers such as, e.g., triazoles, azaindenes, quaternary benzothiazolium compounds, mercapto compounds, water-soluble inorganic salts of cadmium, cobalt, nickel, manganese, thallium and the like; hardeners such as aldehydes including formalin, glyoxal, mucochromic acid, etc., s-triazines, epoxys, aziridines, vinyl-sulfonic acid and the like; coating aids such as, e.g., saponin, sodium polyalkylenesulfonate, lauryl- or oleyl-monoether of polyethylene glycol, amylated alkylurethane, fluorine-containing compounds, and the like; and sensitizers such as, e.g., polyalkylene oxide and the derivatives thereof. Besides, the light-sensitive material may further contain color couplers and, if necessary, a brightening agent, ultraviolet absorbing agent, preservative, matting agent, antistatic agent, and the like.

As the binder for the silver halide photographic light-sensitive material of the present invention, for example, gelatin is used, and in addition to this, there may also be used together gelatin derivatives, such a natural substance as albumin, agar-agar, gum arabic, alginic acid, or the like, polyvinyl alcohol, polyvinyl acrylate, polyvinyl pyrolidone, cellulose ethers, partially hydrolyzed cellulose acetate, hydrophilic polymers such as poly(N-hydroxyl-alkyl)$\beta$-cyanine derivative obtained by the graft-polymerization of ethylene oxide, or the like. Further, as the binder for the silver halide emulsion, dispersion-polymerized vinyl compounds may be used as well; for example, a polymer latex obtained by the emulsion polymerization in the presence of an active agent of an unsaturated ethylene-type monomer, or a polymer latex obtained by the graft-polymerization with use of a ceric salt of a hydroxyl group-having macromolecular compound and an unsaturated ethylene-type monomer. The use of these latexes is desirable for the improvement on the physical characteristics of the emulsion layer.

In addition, there may be allowed to incorporate into the emulsion layer a developer in the protected form, such a higher fatty acid as liquid paraffin, such a higher unsaturated fatty acid as stearylacetoglyceride, etc., in the protected form for the purpose of improving the physical characteristics of the emulsion layer, and further, according to purposes, color couplers, stabilizer, ultraviolet absorbing agent, and the like, also in the protected form.

For the support of the direct-positive-type silver halide photographic light-sensitive material of the present invention, any appropriate, arbitrary photographic support material may be used which includes, e.g., glass, wood, metal, film, paper, or the like, the film including, e.g., cellulose acetate, cellulose acetate-butyrate, cellulose nitrate, polyester, polyamine, polystyrene, and the like, the paper including, e.g., baryta-coated paper, polyolefin-coated paper such as polyethylene- or polypropylene-coated paper, and the like; particularly, the use of polyolefin-coated paper, if subjected to an electron-impact treatment such as corona-discharge treatment, may be useful for the improvement on the adhesion of an emulsion layer.

The direct-positive-type silver halide photographic light-sensitive material of this invention may be used for various purposes such as, e.g., for duplicating, for reproduction, as photographic light-sensitive materials for graphic arts use in making offset printing masters, as special photographic light-sensitive materials for use in radiography, speed-light exposures, electron photography, and the like, or as various direct-positive-type silver halide photographic light-sensitive materials for general copying use, micrographic use, direct-positive-type color photography use, quick-stabilization-type copying use, diffusion transfer process use, color diffusion transfer process use, developer-fixer monobath processing use, and the like. These direct-positive-type silver halide photographic light-sensitive materials have low minimum density and low contrast as compared to conventional ones, and are highly stable during the storage thereof over an extensive period or under a high-temperature-high-humidity condition.

The following examples further illustrate in detail the present invention, but the embodiment of the invention is not limited thereto.

EXAMPLE 1

An aqueous solution containing 1 mole of silver nitrate and an aqueous solution containing 0.25 mole of potassium bromide and 1.0 mole of sodium chloride were simultaneously added to and mixed, spending about 3 minutes, by the double jet method with an aqueous gelatin solution prepared so as to contain 40 mg per mole of silver of potassium iridium hexachloride, kept at 45° C. Subsequently, the water-soluble salt was removed from the mixture by an ordinary aggregation method, and then gelatin was added to the desalted mixture to thereby obtain a silver chlorobromide emulsion whose mean particle size is about 0.3 $\mu$.

To this emulsion were added 10 mg per mole of silver halide of thiourea dioxide, and then the emulsion was ripened at 65° C. and the ripening was continued until the highest characteristics were obtained, thereby fogging the emulsion.

The thus fogged emulsion was divided into 10 equal parts, to which were then added the foregoing exemplified compounds as shown in Table 1, tartrazine as a dye, saponin as a coating aid, and formalin as a hardener, and the respective parts of the emulsion each was coated on a film base so that the coating amount of silver becomes 3.5 g/m$^2$, and then dried.

These samples were allowed to stand over a period of five days in an atmospheric conditon of 55° C. and 50% RH, and after that the aged samples were compared with those non-aged.

Each of the thus obtained samples was exposed through an optical wedge to light in a printer Model P-605FS manufactured by Dainippon Screen, Co., Ltd. The exposed samples each was processed for 20 seconds at 38° C. in a SAKURADOL Type 621 developer (produced by Konishiroku Photo Ind. Co., Ltd.), fixed, washed, and then dried in a SAKURA Automatic Processor Model QS-25 (manufactured by Konishiroku Photo Ind. Co., Ltd.). The samples were subjected to sensitometry tests and the test results are as shown in Table 2 wherein the photographic speeds are relative values to the non-agen speed value of sample No. 2 regarded as 100. The same will apply to Table 3.

TABLE 1

| | Formulas [I], [II] | | Formula [III] | |
|---|---|---|---|---|
| Sample No. | Exemplified compound No. | Adding q'ty [mg/mole AgX] | Exemplified compound No. | Adding q'ty [mg/mole AgX] |
| 1 | — | — | — | — |
| 2 | (a) | 300 | — | — |
| 3 | (a) | 600 | — | — |
| 4 | (b) | 300 | — | — |
| 5 | — | — | (1) | 30 |
| 6 | — | — | (2) | 30 |
| 7 | — | — | (2) | 60 |
| 8 | (a) | 300 | (1) | 30 |
| 9 | (b) | 300 | (1) | 60 |
| 10 | (b) | 300 | (2) | 30 |

TABLE 2

| Sample | Non-aged | | Aged for 5 days 55° C., 50% RH | |
|---|---|---|---|---|
| No. | Speed | D min. | Speed | D min. |
| 1 | 80 | 0.08 | 250 | 0.08 |
| 2 | 100 | 0.04 | 300 | 0.05 |
| 3 | 98 | 0.04 | 290 | 0.04 |
| 4 | 105 | 0.04 | 310 | 0.04 |
| 5 | 80 | 0.10 | 90 | 0.19 |
| 6 | 82 | 0.11 | 85 | 0.22 |
| 7 | 77 | 0.12 | 75 | 0.25 |
| 8 | 101 | 0.04 | 105 | 0.05 |
| 9 | 98 | 0.04 | 98 | 0.04 |
| 10 | 102 | 0.04 | 108 | 0.04 |

As apparent from Table 2, samples No. 8 to No. 10 for the invention, after being aged under the condition of 55° C./50% RH for 5 days, show little deteriorated, very stable and excellent photographic characteristics.

The same samples were allowed to stand over a period of 6 months under an atmospheric condition of 23° C./50% RH, and after that the aged samples were exposed and processed in the same manner as previously described. The obtained results are as shown in Table 3.

TABLE 3

| Sample | 23° C./50% RH for 6 months | |
|---|---|---|
| No. | Speed | D min. |
| 1 | 270 | 0.08 |
| 2 | 310 | 0.04 |
| 3 | 290 | 0.04 |
| 4 | 300 | 0.04 |
| 5 | 88 | 0.17 |
| 6 | 86 | 0.20 |
| 7 | 78 | 0.25 |
| 8 | 103 | 0.05 |
| 9 | 99 | 0.04 |
| 10 | 105 | 0.04 |

As apparent from Table 3, like the results shown in Table 2, samples No. 8 to No. 10 show substantially as good photographic characteristics after being aged for 6 months as those of the non-aged.

EXAMPLE 2

An aqueous potassium bromide and potassium iodide solution and an aqueous silver nitrate solution were simultaneously added, spending about 50 minutes, to and mixed with an aqueous gelatin solution of pH 2.0 prepared so as to contain 40 mg per mole of silver of potassium iridium (III) hexachloride kept at a temperature of 60° C. This emulsion was neutralized and then cooled. The water-soluble salt was removed from the emulsion by an ordinary aggregation method. Gelatin was then added to the desalted emulsion to thereby prepare a silver iodobromide emulsion which contains 1.5 mole % silver iodide and whose mean particle size is about 0.2$\mu$.

This emulsion, after adding 8 mg per mole of silver halide of thiourea dioxide thereto, was ripened at 65° C. for 60 minutes, and then, after adding 3 mg per mole of silver halide of chloroauric acid thereto, was again ripened at 65° C. until the maximum characteristics were obtained, thereby fogging the emulsion.

Thus fogged emulsion was divided into 9 equal parts, to which were then added the foregoing exemplified compounds as shown in Table 4, saponin as a coating aid, and mucochloric acid as a hardening agent. Each of the parts of the emulsion was coated on a film base so that the coating amount of silver is 3.5 g/m$^2$, thus preparing 9 samples.

Each sample was exposed, processed and aged in the same manner as in Example 1, and then compared with the non-aged.

The obtained samples each was exposed through an optical wedge to the tungsten light of a printer, developed in SAKURADOL Lithotype 271 developer (produced by Konishiroku Photo Ind. Co., Ltd.) at 27° C. for 1 minute and 40 seconds, fixed, washed and then dried in a SAKURA Automatic Processor Model GQ-25 (manufactured by Konishiroku Photo Ind. Co., Ltd.). The processed samples were subjected to sensitometry tests, and the test results are as shown in Table 5 wherein the speeds are indicated in relative values to the non-aged speed value of sample No. 11 regarded as 100.

TABLE 4

| Sample No. | Formulas [I], [II] Exemplified compound No. | Formulas [I], [II] Adding q'ty [mg/mole AgX] | Gold compound Exemplified compound No. | Gold compound Adding q'ty [mg/mole AgX] |
|---|---|---|---|---|
| 11 | — | — | — | — |
| 12 | (b) | 400 | — | — |
| 13 | (b) | 800 | — | — |
| 14 | (d) | 400 | — | — |
| 15 | — | — | Chloroauric acid | 6 |
| 16 | — | — | Chloroauric acid | 9 |
| 17 | (b) | 400 | Chloroauric acid | 9 |
| 18 | (d) | 400 | Chloroauric acid | 6 |
| 19 | (d) | 400 | Chloroauric acid | 9 |

TABLE 5

| Sample No. | Non-aged Speed | Non-aged D min. | Aged for 5 days 55° C./50% RH Speed | Aged for 5 days 55° C./50% RH D min. |
|---|---|---|---|---|
| 11 | 100 | 0.05 | 230 | 0.05 |
| 12 | 125 | 0.03 | 300 | 0.03 |
| 13 | 130 | 0.03 | 350 | 0.03 |
| 14 | 120 | 0.03 | 330 | 0.03 |
| 15 | 95 | 0.07 | 100 | 0.10 |
| 16 | 93 | 0.10 | 90 | 0.14 |
| 17 | 105 | 0.03 | 100 | 0.03 |
| 18 | 110 | 0.03 | 110 | 0.03 |
| 19 | 106 | 0.03 | 105 | 0.03 |

As apparent from Table 5, samples No. 17 to No. 19, after being aged for five days under the condition of 55° C./50% RH, shows little deteriorated, very stable and excellent photographic characteristics.

EXAMPLE 3

To an aqueous gelatin solution prepared so as to contain 30 mg per mole of silver of rhodium trichloride, kept at 30° C., was added an aqueous solution containing 1 mole of silver nitrate and then added an aqueous solution containing aqueous ammonia and 1.1 mole of potassium bromide, and mixed them to thereby prepare an emulsion. This emulsion was neutralized and then treated by an ordinary aggregation method to remove the water-soluble salt therefrom, and subsequently gelatin was added to the emulsion to thereby produce an ammoniacal silver bromide emulsion whose mean particle size is about 0.3$\mu$.

Next, the emulsion, after adding 12 mg per mole of silver halide of thiourea dioxide thereto, was ripened at 65° C. until the maximum characteristics were obtained, thereby fogging the emulsion.

The thus fogged emulsion was divided into several equal parts, to which were then added the foregoing exemplified compounds as shown in Table 6, tartrazine as a dye, saponin as a coating aid and formalin as a hardening agent, and each of the respective parts of the emulsion was coated on a film base so that the coating amount of silver is 3.5 g/m$^2$, and then dried, thereby preparing samples. Each of the samples was exposed through an optical wedge to light in a daylight-operatable printer (HMW-215, manufactured by Ōku Seisakusho), developed in SAKURADOL Type 621 developer (produced by Konishiroku Photo Ind. Co., Ltd.) for 20 seconds at 38° C., fixed, washed and then dried in a SAKURA Automatic Processor Model QS-25 (manufactured by Konishiroku Photo Ind. Co., Ltd.). The processed samples were subjected to sensitometry tests. The test results are as shown in Table 7 wherein the speeds are indicated in relative values to the non-aged speed value of sample No. 25 regarded as 100.

TABLE 6

| Sample No. | Formulas [I], [II] Exemplified compound No. | Formulas [I], [II] Adding q'ty [mg/mole AgX] | Formula [III] Exemplified compound No. | Formula [III] Adding q'ty [mg/mole AgX] | Gold compound Compound | Gold compound Adding q'ty [mg/mole AgX] |
|---|---|---|---|---|---|---|
| 20 | — | — | — | — | — | — |

TABLE 6-continued

| Sample No. | Formulas [I], [II] Exemplified compound No. | Formulas [I], [II] Adding q'ty [mg/mole AgX] | Formula [III] Exemplified compound No. | Formula [III] Adding q'ty [mg/mole AgX] | Gold compound Compound | Gold compound Adding q'ty [mg/mole AgX] |
|---|---|---|---|---|---|---|
| 21 | (a) | 400 | — | — | — | — |
| 22 | (a) | 400 | (3) | 60 | — | — |
| 23 | (d) | 400 | (3) | 60 | — | — |
| 24 | (a) | 400 | — | — | Chloroauric acid | 10 |
| 25 | (a) | 400 | (4) | 60 | Chloroauric acid | 10 |

TABLE 7

| Sample No. | Non-aged Speed | Non-aged D min. | Aged for 5 days 55° C./50% RH Speed | Aged for 5 days 55° C./50% RH D min. |
|---|---|---|---|---|
| 20 | 90 | 0.06 | 270 | 0.08 |
| 21 | 110 | 0.04 | 300 | 0.04 |
| 22 | 108 | 0.04 | 100 | 0.04 |
| 23 | 105 | 0.04 | 95 | 0.04 |
| 24 | 103 | 0.04 | 105 | 0.04 |
| 25 | 100 | 0.04 | 95 | 0.04 |

As apparent from Table 7, samples No. 22 to No. 25, after being aged for 5 days under the condition of 55° C./50% RH, show little deteriorated, very stable and excellent photographic characteristics.

What is claimed is:

1. A direct-positive silver halide photographic material, whose speed is stable and whose minimum density is small under a high temperature and a high humidity, said material comprising a support, a silver halide emulsion layer comprising fogged silver halide particles prepared in the presence of a water soluble iridium salt or a water soluble rhodium salt, and a hydrophilic colloidal layer comprising a compound selected from the group consisting of compounds having the following Formula I and II and at least one compound selected from the group consisting of a compound having the following Formula III and a gold compound, Formula I

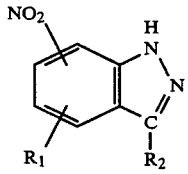

wherein $R_1$ is hydrogen, an alkyl, —$SO_3M$ or —COOM radical wherein M is hydrogen, an alkaline metal or ammonium ion, and $R_2$ is hydrogen or a lower alkyl radical, Formula II

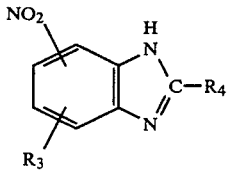

wherein $R_3$ is hydrogen, an alkyl, —$SO_3M$ or —COOM radical wherein M is hydrogen, an alkaline metal or ammonium ion, and $R_4$ is hydrogen, an alkyl or —$CH_2$—S—$(CH_2)_n$—Y′ radical wherein n is an integer of from 1 to 3, and Y′ is hydrogen or —$SO_3M$ radical, Formula III $$H_2N—Y\text{-}\!\!\left[NH—Y\right]_{\#}NH_2$$

is an integer of from 1 to 5, and Y is an alkylene radical having from 2 to 4 carbon atoms, provided not less than 2 Ys present inside the same molecule are allowed to be different alkylene radicals, wherein the adding quantity of the compound having Formula III is from $1.0\times10^{-7}$ to $1.0\times10^{-2}$ mole per mole of silver halide and the adding quantity of the gold compound in from $1.0\times10^{-7}$ to $1.0\times10^{-4}$ mole per mole of silver halide.

2. A material according to claim 1, wherein said hydrophilic colloidal layer has a compound having Formula I and a compound having Formula III.

3. A material according to claim 1, wherein said hydrophilic colloidal layer has a compound having Formula I and a gold compound.

4. A material according to claim 1, wherein said hydrophilic colloidal layer has a compound having Formula II and a compound having Formula III.

5. A material according to claim 1, wherein said hydrophilic colloidal layer has a compound having Formula II and a gold compound.

6. A material according to claim 1, wherein $R_1$ of Formula I is a hydrogen atom.

7. A material according to claim 1, wherein $R_3$ of Formula II is a hydrogen atom.

8. A material according to claim 1, wherein $R_4$ of Formula II is a hydrogen atom.

9. A material according to claim 1, wherein a compound having Formula III is selected from the group consisting of diethyltriamine, triethylenetetramine, tetraethylenepentamine, pentaethylenehexamine, hexaethyleneheptamine, tripropylenetetramine, dibutylenetriamine, spermine, spermidine, n-(4-aminobutyl)-cadaverine.

10. A material according to claim 1, wherein said iridium salt is a potassium iridium(III) hexachloride or a sodium iridium (III) hexachloride.

11. A material according to claim 1, wherein said rhodium salt is a rhodium(III) trichloride, a rhodium(IV) tetrachloride or a potassium rhodium(III) hexabromide.

12. A material according to claim 1, wherein said iridium salt is a iridium chloride.

13. A material according to claim 1, wherein said rhodium salt is a rhodium chloride.

14. A material according to claim 1, wherein said gold compound is a monovalent or trivalent water-soluble gold salt.

15. A material according to claim 11, wherein said gold compound is selected from the group consisting of chloroauric acid, potassium chloroaurate, gold thiocyanate, sodium chloroaurate, potassium aurate, potassium chloroaurate, potassium bromoaurate, potassium iodoaurate, potassium gold cyanide, potassium gold thiocyanide, gold thioglucose.

16. A material according to claim 11, wherein said gold compound is selected from the group consisting of chloroauric acid, potassium chloroaurate, gold sulfide and gold selenide.

17. A material according to claim 1, wherein the adding quantity of the compounds having Formula I and II is from $1.0\times10^{-6}$ to $1.0\times10^{-1}$ mole per mole of silver halide.

18. A material according to claim 1, wherein the adding quantity of the compound having Formula III is from $1.0\times10^{-5}$ to $5.0\times10^{-3}$ mole per mole of silver halide.

19. A material according to claim 1, wherein the adding quantity of the gold compound is from $1.0\times10^{-6}$ to $5.0\times10^{-4}$ mole per mole of silver halide.

20. A material according to claim 12, wherein said gold compound is selected from the group consisting of choloroauric acid, potassium chloroaurate, gold sulfide and gold selenide.

* * * * *